US009003999B2

(12) United States Patent
Bischoff et al.

(10) Patent No.: US 9,003,999 B2
(45) Date of Patent: Apr. 14, 2015

(54) LIQUID CONSUMPTION COUNTERS

(75) Inventors: Julie A. Bischoff, Red Wing, MN (US); Brian J. Bischoff, Red Wing, MN (US)

(73) Assignee: Bischoff Holdings, Inc., Red Wing, MN (US)

( * ) Notice: Subject to any disclaimer, the term of this patent is extended or adjusted under 35 U.S.C. 154(b) by 324 days.

(21) Appl. No.: 13/545,552

(22) Filed: Jul. 10, 2012

(65) Prior Publication Data

US 2014/0014027 A1 Jan. 16, 2014

(51) Int. Cl.

| | |
|---|---|
| ***A47G 23/16*** | (2006.01) |
| ***A47G 23/12*** | (2006.01) |
| ***G09F 11/04*** | (2006.01) |
| ***G09F 11/23*** | (2006.01) |

(52) U.S. Cl.

CPC ..... *G09F 11/04* (2013.01); *G09F 11/23* (2013.01)

(58) Field of Classification Search

CPC ..... A47G 23/12; A47G 23/14; A47G 23/16; A47G 2200/18; A61J 7/04; G09F 11/04; G09F 11/23

USPC ..... 116/307, 308, 309, 311, 312, 313, 314, 116/315, 316, 317, 318; 206/459.1; 215/230; 40/306, 307, 310, 311, 324

See application file for complete search history.

(56) References Cited

U.S. PATENT DOCUMENTS

| | | | | |
|---|---|---|---|---|
| 2,111,637 | A | 3/1938 | Mehaffey | |
| 2,493,757 | A | 1/1950 | Fish | |
| 2,767,680 | A | 10/1956 | Lermer | |
| 3,599,362 | A * | 8/1971 | Klober | 40/324 |
| 3,787,993 | A * | 1/1974 | Lyon | 40/306 |
| 3,996,879 | A | 12/1976 | Walton | |
| 4,877,119 | A * | 10/1989 | Hosking | 206/459.1 |
| 4,901,457 | A | 2/1990 | Chandler | |
| 5,356,012 | A | 10/1994 | Tang et al. | |
| 5,482,163 | A | 1/1996 | Hoffman | |
| 5,525,383 | A * | 6/1996 | Witkowski | 428/30 |
| 5,586,087 | A | 12/1996 | Silverson | |
| 5,607,078 | A | 3/1997 | Nordberg et al. | |
| 5,644,298 | A * | 7/1997 | Brooks et al. | 340/612 |
| 5,845,777 | A * | 12/1998 | Najmi | 206/459.1 |
| 5,896,990 | A * | 4/1999 | Barzana | 206/459.1 |
| 5,896,996 | A | 4/1999 | Chuang | |
| 6,212,803 | B1 * | 4/2001 | Key | 40/324 |
| 6,802,279 | B1 * | 10/2004 | Johnson | 116/306 |
| 6,805,072 | B1 * | 10/2004 | DeSano | 116/308 |
| 7,004,105 | B2 | 2/2006 | Bucksch | |
| 7,107,838 | B2 | 9/2006 | Chai et al. | |
| 7,581,640 | B2 | 9/2009 | Lopez | |
| 7,650,883 | B2 | 1/2010 | Scarrott et al. | |
| 7,959,023 | B2 * | 6/2011 | Ferrara | 215/230 |
| 8,051,997 | B2 | 11/2011 | Buckley | |
| 2006/0108257 | A1 * | 5/2006 | Packard | 206/534 |
| 2006/0207132 | A1 * | 9/2006 | Vaughan et al. | 40/310 |
| 2006/0278156 | A1 * | 12/2006 | Miller | 116/112 |

(Continued)

FOREIGN PATENT DOCUMENTS

| | | | | |
|---|---|---|---|---|
| CA | 2067961 C * | 5/1992 | | A47G 23/16 |
| DE | 19951466 A1 * | 5/2001 | | A47G 23/16 |

*Primary Examiner* — R. A. Smith

(57) ABSTRACT

Liquid consumption counter devices are described herein. One liquid consumption counter device can comprise a body having a number of indicator points, and a counter coupled to the body, wherein the counter rotates around the body to each of the number of indicator points and wherein rotation of the counter to each of the consecutive indicator points indicates consumption of a volume of liquid.

17 Claims, 4 Drawing Sheets

(56) References Cited

U.S. PATENT DOCUMENTS

2008/0087624 A1* 4/2008 Buckley ..... 215/230
2008/0257898 A1* 10/2008 Pollio ..... 220/703
2009/0026103 A1* 1/2009 Sieber ..... 206/459.1
2009/0289026 A1* 11/2009 Ferrara ..... 215/230
2013/0060224 A1* 3/2013 Young Jones ..... 604/500

* cited by examiner

LIQUID CONSUMPTION COUNTERS

BACKGROUND OF THE DISCLOSURE

Adequate consumption of liquid within a period of time can be beneficial for a number of health reasons. For example, drinking adequate amounts of water in a day can assist in weight loss and/or a diet, keep muscles in the body energized, keep skin looking healthier, and assist kidney functioning, among many other benefits. Health professionals recommend that a human consume sixty-four ounces of liquid (e.g., water) a day to maintain the body and to insure proper functioning.

DETAILED DESCRIPTION OF THE DISCLOSURE

Figure 1:
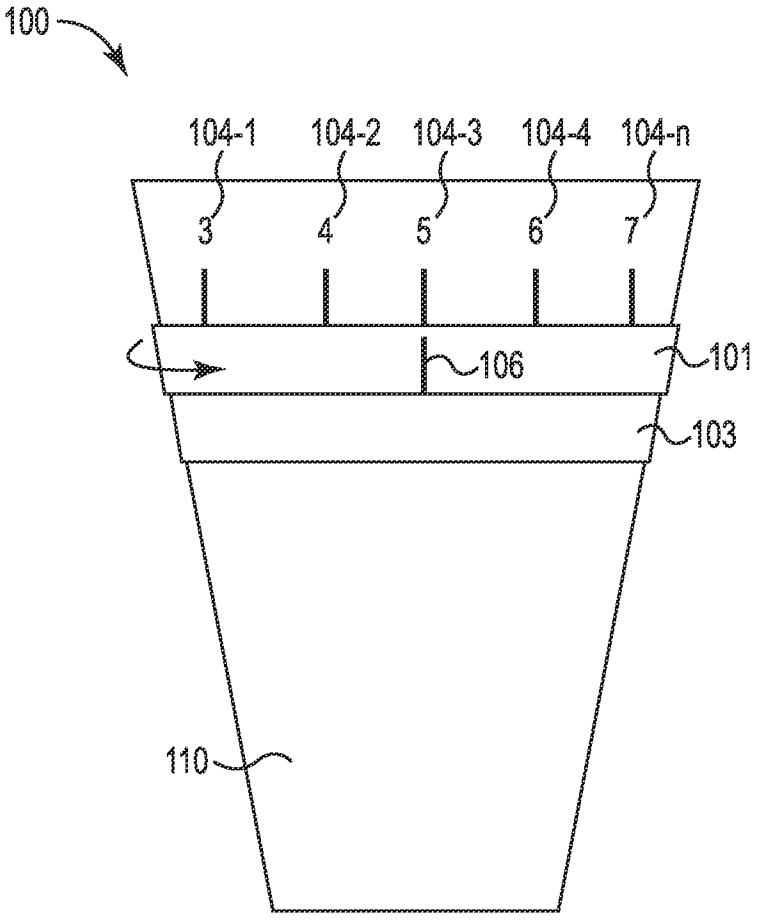
FIG. 1 illustrates a liquid consumption counter device in accordance with one or more embodiments of the present disclosure.

Liquid consumption counter devices and systems are described herein. For example, in one or more embodiments of the present disclosure a liquid consumption counter device can include a body shaped as a hollow truncated cone (HTC) having a number of indicator points, and a counter coupled to the body, wherein the counter rotates around the body to each of the number of indicator points and wherein rotation of the counter to each of the consecutive indicator points indicates consumption of a volume of liquid.

The human body is composed primarily (e.g., estimated 66%) of water. Proper water consumption can be important to maintain the human body and insure its proper functioning. Daily water consumption, for example, can be particularly essential for a person on a diet, with a particular disease, and/or on a medication that may dehydrate a person, among many other instances. Further, changes in the amount of liquid consumed by a person (e.g., a patient) in a day can assist medical personnel in diagnosing medical conditions, preventing further medical problems, and identifying adverse reactions, among other benefits.

For instance, not drinking an adequate amount of water can directly cause kidney stones. Similarly, a risk factor for urinary tract infections can include inadequate water consumption. For examples, dehydration can allow infection causing bacteria to build up in a person's bladder which may then lead to a urinary tract infection. Accordingly, it is believed that drinking sufficient amounts of water can help to prevent bacteria from building up in the bladder and/or flush out any bacteria built up in the bladder and urinary tract.

Further, for a patient with heart failure, consuming excess fluid can make the patient's heart work harder to pump that fluid around in the patient's body. This can increase the difficulty of breathing, and for this reason, people who are experiencing congestive heart failure or those who are especially prone to it may be placed on a fluid-restricted diet.

In addition to counting water consumption, it may be beneficial to track consumption of various other liquids. For example, a parent may desire to track consumption of baby formula by an infant. An athlete may desire to track consumption of electrolyte liquid (e.g., Gatorade®) consumed after working out to ensure the athlete is replenishing the athlete's body with nutrients. And, a person on a diet and/or concerned with vitamin intake can track consumption of juice to assist in determining the amount of vitamin and/or calorie intake in a day.

A number of medical conditions may require that a person and/or medical personnel limit the amount of liquid consumed by the person. For example, a person with diabetes may be required to limit the amount of high-sugar liquid (e.g., soda pop and concentrated juice) consumed in a period of time. Further, a person with kidney failure, dialysis, and/or near surgery may need to keep track and/or limit the amount of liquid consumed in a period of time. And, a person in cardiac care (e.g., with heart failure) may be required to limit the consumption of liquid in a day to prevent taking in excess liquids. As discussed above, taking in excess liquid with heart failure, for instance, can cause a patient's heart to work harder to pump the liquid around their body.

Counting liquid consumption in a period of time (e.g., a day) can be a difficult task. It can be easy for a person to forget how many glasses of liquid have been consumed during a period of time (e.g., in a day) and self reporting of a volume of liquid consumed in a period of time can be unreliable. Further, in a medical environment, such as a hospital and/or nursing home, a number of staff over a number of shifts may be responsible for tracking liquid consumed by a patient. This can make it difficult to ensure that a patient is drinking a sufficient amount of liquid and/or to detect a change in the amount of liquid a patient is consuming.

Liquid consumption counting devices in accordance with one or more embodiments of the present disclosure may include a body having a hollow truncated cone (HTC) with a number of indicator points, and a counter coupled to the body. The liquid consumption devices can allow a person to count liquid consumed in a period of time by rotating the counter around the body as the person consumes liquid. Further, a person can keep a running count of the number of times a liquid container is refilled throughout a period of time. Thereby, liquid consumed can be counted in a simple manner and/or simultaneously with each refill of a liquid container.

The figures herein follow a numbering convention in which the first digit or digits correspond to the drawing figure number and the remaining digits identify an element or component in the drawing. Similar elements or components between different figures may be identified by the use of similar digits. For example, 110 may reference element "10" in FIG. 1B, and a similar element may be referenced as 210 in FIG. 2. As will be appreciated, elements shown in the various embodiments herein can be added, exchanged, and/or eliminated so as to provide a number of additional embodiments of value.

FIG. 1 illustrates a liquid consumption counter device 100 in accordance with one or more embodiments of the present disclosure. A liquid consumption counter device 100 can be used to count liquid consumption by a person within a period of time, for instance. A liquid can include water, juice, soda pop, milk, and baby formula, among many others.

Figure 2A:
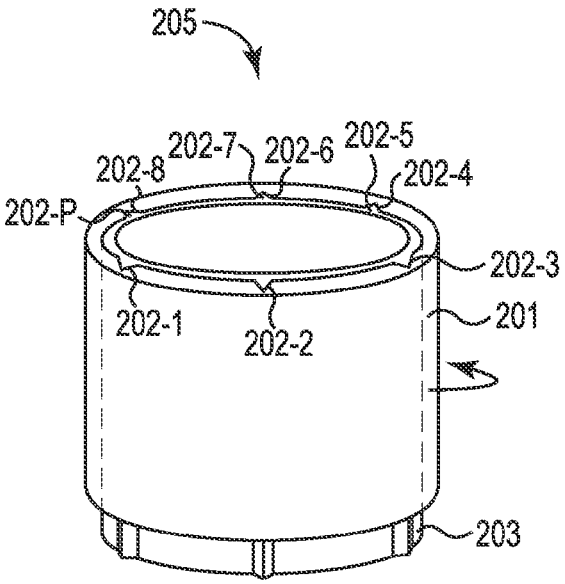
FIGS. 2A-2C illustrate a liquid consumption counter device in accordance with one or more embodiments of present disclosure.
Figure 2B:
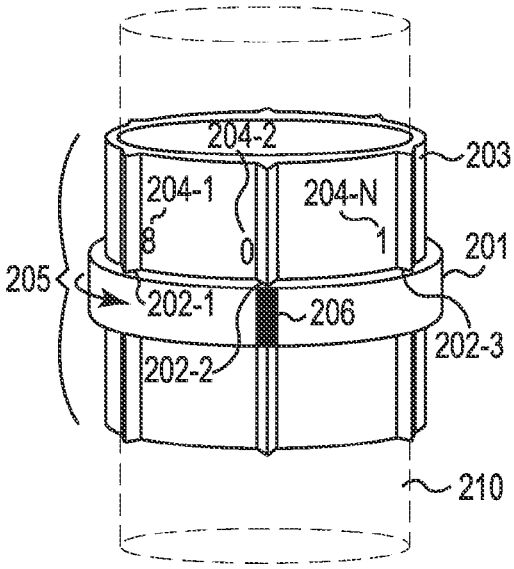
Figure 2C:
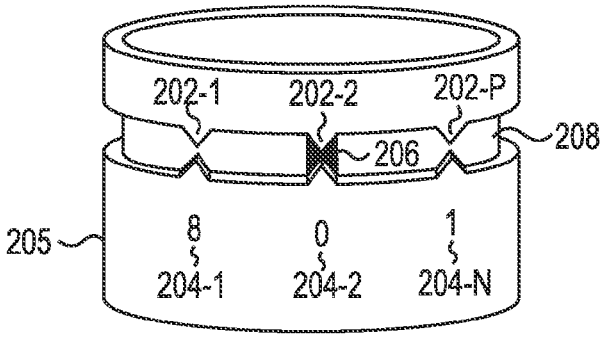

The liquid consumption counter device 100 of FIG. 1 can include a body (having two parts 101, 103) having a number of indicator points, and a counter 106 coupled to the body parts 101, 103, wherein the counter 106 rotates around the body part 101 to each of the number of indicator points and wherein rotation of the counter 106 to each of the consecutive indicator points indicates consumption of a volume of liquid. For example, the indicator points (as shown in FIGS. 2A-2C) can be associated with a number of markings 104-1, 104-2, 104-3, 104-4 . . . 104-N.

The number of markings 104-1, 104-2, 104-3, 104-4 . . . 104-N can include, for example, a numerical value representing an amount and/or volume of liquid. The markings 104-1, 104-2 . . . 104-N can be located on the body parts 101, 103 and/or on a liquid container 110. The number of markings 104-1, 104-2 . . . 104-N can include consecutively ordered whole numerals with the largest numeral adjacent to zero. Each of the whole numerals, for example, can represent a time that a liquid container is filled with liquid and/or a number of times the liquid container is finished. For instance, rotation of the counter to each of the number of markings associated with a consecutive indicator point can indicate consumption of a volume of liquid.

In some embodiments of the present disclosure, the body parts 101, 103 of the liquid consumption counter device 100 can include two rings. A ring, for example, can be a HTC. For instance, a first ring 101 can include a polymeric ring (e.g., a Teflon® ring) with the counter 106. The second ring 103, for example, can include an elastomeric ring that can hold the first ring 101 in place.

The first ring 101, for example, can rotate around the circumference of a liquid container 110 and/or the second ring 103 to each of the number of indicator points to count a volume of liquid consumed. The first ring 101 and second ring 103, for instance, can have a number of indicator points. For instance, an indicator point on the first ring 101 can lock and/or grip onto an indicator point on the second ring 103.

As an example in accordance with one or more embodiments of the present disclosure, a person may drink one liquid container 110 of liquid. After drinking one liquid container 110, the person and/or a caretaker can rotate the body parts 101, 103 (e.g. rotate the first ring 101 with respect to the second ring 103) so that the counter 106 is associated with the marking 1.

In various embodiments of the present disclosure, the counter 106 can include a locking mechanism (e.g., gripping mechanism) to lock (e.g., grip) at the number of indicator points. The locking mechanism can allow the counter to be resistant to movement with basic use of the liquid consumption counter 100. For example, a locking mechanism can include a number of male connectors associated with the indicator points and a female connector associated with the counter 106 and/or vice versa. The female connector can couple with the number of male connectors to lock the counter 106 into place. The number of male connectors, for example, can include a triangle shape, a rectangle shape, and a semi-circle (e.g., semi-ellipse) shape, among many others. The female connector can include an inverse shape of the number of male connectors (e.g., triangle, rectangle, and semi-circle). In various embodiments, the number of male connectors and female connectors can be any suitable number.

FIGS. 2A-2C illustrate a body 205 of a liquid consumption counter device in accordance with one or more embodiments of present disclosure. For example, the body 205 of the liquid consumption counter devices in FIGS. 2A-2C can include a body configured for placement around a liquid container. For instance, a liquid container can include a water container, water bottle, mug, cup, or a baby bottle, among many others.

FIG. 2A illustrates a body 205 of a liquid consumption counter device in accordance with one or more embodiments of the present disclosure. A body can be any suitable shape to fit around a liquid container. For example, a body can include a cylinder shape and/or an elliptical cylinder shape. The body 205 can include a polymeric material (e.g., Teflon), a plastic material, and/or a rubber material, among many other material types.

The body 205, for example, can include multiple rings (e.g., tubes, portions, HTCs). For instance, a first ring 201 can include a polymeric ring (e.g., Teflon ring) containing a counter. A second ring 203, for example, can include an elastomeric ring that can retain the first ring 201 in place. For instance, the first ring 201 can rotate around the circumference of a liquid container and lock (e.g., grip) at a number of indicator points 202-1, 202-2, 202-3, 202-4, 202-5, 202-6, 202-7, 202-8 . . . 202-P to count a volume of liquid consumed. The number of indicator points 202-1, 202-2, 202-3, 202-4, 202-5, 202-6, 202-7, 202-8 . . . 202-P can include a number of male and female indicator points, for example. For instance, a female indicator point can be located on the first ring 201 that can fit onto and/or couple with a number of male indicator points that can be located on the second ring 203, and/or vice versa.

FIG. 2B illustrates a liquid consumption counter device comprising a body 205, indicator points 202-1, 202-2 . . . 202-P on the body 205, and markings 204-1, 204-2 . . . 204-N associated with each of the indicator points 202-1, 202-2 . . . 202-P in accordance with one or more embodiments of the present disclosure. The body 205 can include a first ring 201 (e.g., a Teflon ring) and a second ring 203 (e.g., elastomeric ring). For example, the indicator points 202-1, 202-2 . . . 202-P can be located on the top, middle, and/or bottom of the body 205 (e.g., on the first ring 201 and/or the second ring 203). The markings 204-1, 204-2 . . . 204-N associated with each of the indicator points 202-1, 202-2 . . . 202-P can include a numerical value (e.g., number).

The markings can be printed on or applied to a liquid container 210 and/or on the body 205 (e.g., on the first ring 201 and/or the second ring 203). The numerical value, for instance, can indicate an amount and/or volume of liquid consumed. The indicator points 202-1, 202-2 . . . 202-P can be located around the circumference of the body 205 and the numerical value associated with each successive indicator point can increase around the circumference of the body 205 (e.g., a beginning numerical value can be adjacent to an ending numerical value).

The liquid consumption device of FIG. 2B can include a counter 206. The counter 206 can be printed on the body 205, can be applied (e.g., a sticker) to the body 205 and/or can include a separate piece of material (e.g., a separate plastic clip), for example. In a number of embodiments of the present disclosure, the counter 206 can be printed on the ring 201 of the body 205. The ring 201 with the counter 206 can rotate around the circumference of a liquid container 210 to count liquid consumed. The ring 201, for example, can lock and/or grip at the number of indicator points 202-1, 202-2 . . . 202-P that can be located on the body 205 to limit unintentional movement of the counter 206 with basic use of the liquid consumption counter device.

In some embodiments of the present disclosure, the counter 206 can include a clip (e.g., a plastic clip). A clip, for example, can movably attach to the body 205. For instance, the clip can attach to the top of the first ring 201 and rotate around the circumference of the liquid container 210. The first ring 201 can include a raised portion with an edge on each side of the raised portion, wherein the clip can attach to the edges. The number of indicator points can be on the raised portion of the first ring 201. The clip, for example, can include inwardly extending pieces to engage with the number of indicator points.

FIG. 2C illustrates a liquid consumption counter device comprising a body 205, a number of indicator points 202-1, 202-2 . . . 202-P on the body 205, markings 204-1, 204-2 . . . 204-N associated with each of the number of indicator points 202-1, 202-2 . . . 202-P, a counter 206, and a channel 208 in accordance with one or more embodiments of the present disclosure. The counter 206, for example, can be inside the channel 208 and can rotate around the circumference of the body 205. The counter 206 can include a material (e.g., plastic, polymeric, and/or rubber) that can lock and/or grip at the number of indicator points 202-1, 202-2 . . . 202-P. The indicator points 202-1, 202-2 . . . 202-P can be on, inside, and/or associated with the channel 208, for example. The markings 204-1, 204-2 . . . 204-N can include a representation of amount and/or volume of liquid consumed.

In some embodiments of the present disclosure, the counter 206 can include a ring located inside the channel 208 on the body 205. The ring (e.g., as shown in FIG. 2B: 201) can include a ring with a counter 206 marked on the ring. For example, the ring with the counter 206 can rotate around the body 205. The body 205, for example, can include a ring that can be placed around a liquid container (e.g., 210 in FIG. 2B). The markings 204-1, 204-2 . . . 204-N associated with each of the indicator points 202-1, 202 . . . 202-P can be on the body 205, for example.

Figure 3A:
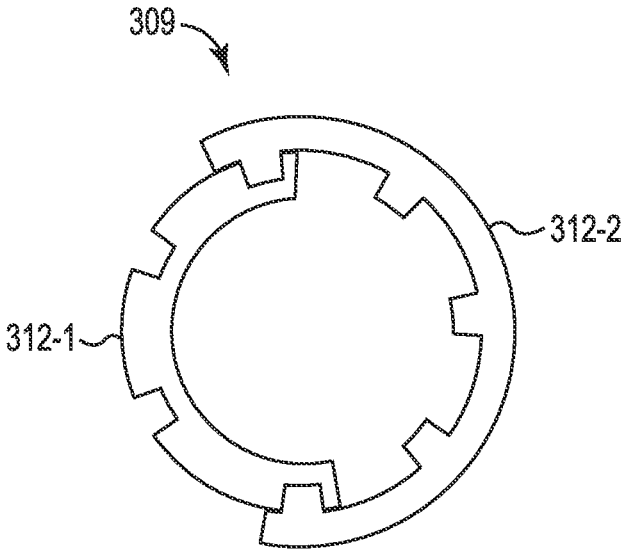
FIG. 3A illustrates a top view of an adjustable liquid consumption counter device in accordance with one or more embodiments of the present disclosure.

FIG. 3A illustrates a top view of an adjustable body 309 of a liquid consumption counter device in accordance with one or more embodiments of the present disclosure. The adjustable body 309 can include an adjustable cylinder shaped body, for example. For instance, an adjustable cylinder shaped body can be an elliptical cylinder shape. The adjustable body 309, for example, can be mechanically adjustable to fit around a liquid container.

The adjustable body 309 can include a first portion 312-1 and a second portion 312-2, wherein the first portion 312-1 couples to the second portion 312-2 to mechanically adjust (e.g., fit) around a liquid container. For example, the first portion 312-1 can include a number of female connectors that can couple to a number of male connectors on the second portion 312-2. The adjustable body 309 can, for example, be mechanically adjusted to fit around containers of different sizes.

Figure 3B:
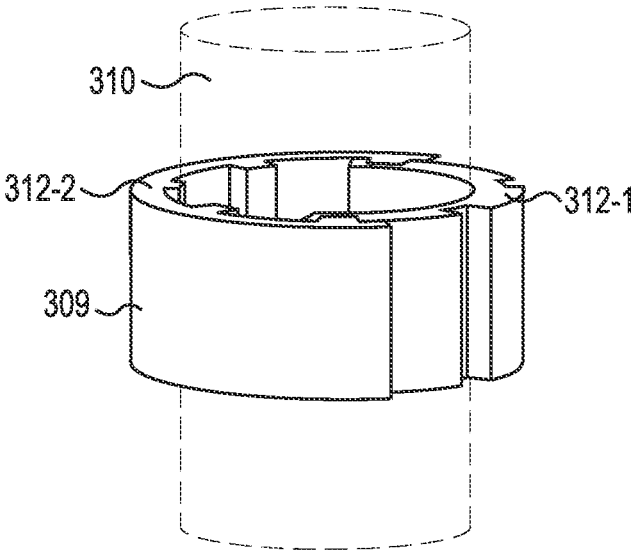
FIG. 3B illustrates a side view of an adjustable liquid consumption counter device in accordance with one or more embodiments of the present disclosure.

FIG. 3B illustrates a side view of an adjustable body 309 of a liquid consumption counter device in accordance with one or more embodiments of the present disclosure. The adjustable body 309 can include a first portion 312-1 and a second portion 312-2, wherein the first portion 312-1 couples to the second portion 312-2 to mechanically adjust around a liquid container 310. The adjustable HTC 309 can include a plastic, polymeric, and/or rubber material, for example.

In some embodiments of the present disclosure, a liquid consumption counter device including an adjustable body 309 can include a number of indicator points on the adjustable body 309, and a counter coupled to the adjustable body 309, wherein the counter slides around the circumference adjustable body 309 to each of the number of indicator points (as shown in FIGS. 2A-2C). Sliding the counter to each of the consecutive indicator points can indicate consumption of a volume of liquid. The number of indicator points can be associated with markings to indicate an amount and/or volume of liquid, for instance.

Figure 4:
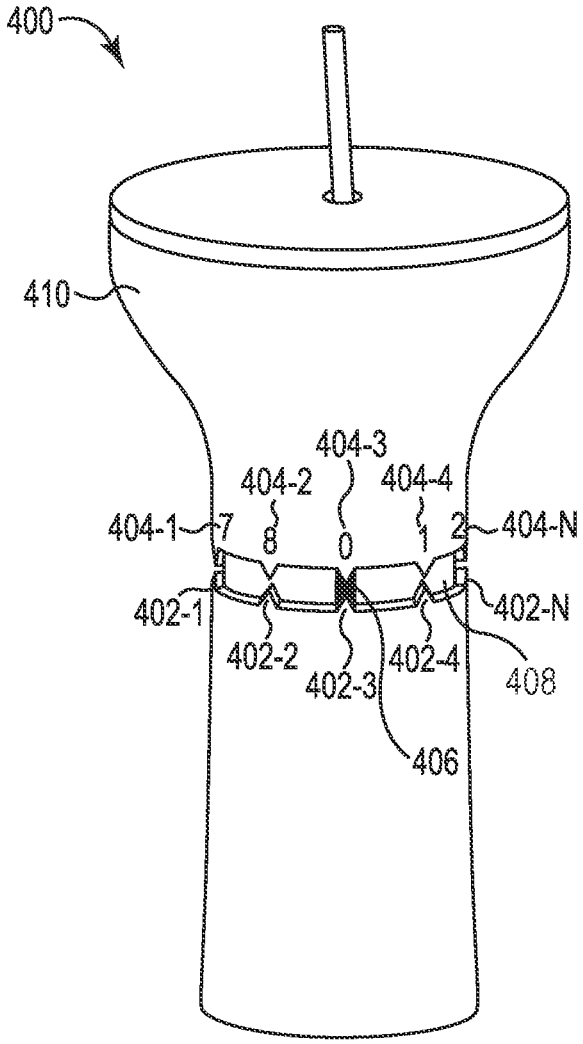
FIG. 4 illustrates a liquid consumption counter device in accordance with one or more embodiments of the present disclosure.

FIG. 4 illustrates a liquid consumption counter device in accordance with one or more embodiments of the present disclosure. The liquid consumption counter device 400 of FIG. 4 can include a liquid container 410, a number of indicator points 402-1, 402-2, 402-3, 402-4 . . . 402-N, and a counter 406. A liquid container 410 can include a container for holding and/or receiving liquid. For example, a liquid container 410 can be a water bottle, a cup, a disposable cup, a mug (e.g., a coffee mug), and a baby bottle, among many other container types. The liquid container can hold a liquid, such as water, juice, milk, and/or soda pop, among other liquids. The liquid container, for example, can include various sizes and/or volumes (e.g., 8 ounces, 1 cup, 1 liter).

The number of indicator points 402-1, 402-2, 402-3, 402-4 . . . 402-N can each indicate an amount and/or volume of liquid. The indicator points 402-1, 402-2, 402-3, 402-4 . . . 402-N, for instance, can be located around the circumference of the liquid container 410. For example, each indicator point 402-1, 402-2, 402-3, 402-4 . . . 402-N can be associated with a marking. A marking can include a numerical value 404-1, 404-2, 404-3, 404-4 . . . 404-N. For example, the numerical values of the indicator points 402-1, 402-2, 402-3, 402-4 . . . 402-N can increase around the circumference of the liquid container 410. For instance, the markings can end at a beginning numerical value. In some embodiments, a liquid consumption counter device 400 can include nine numerical values. For instance, the nine numerical values can include 0, 1, 2, 3, 4, 5, 6, 7, and 8, wherein the beginning marking (e.g., 0) can be adjacent to the ending marking (e.g., 8). However, embodiments of the present disclosure are not limited to a particular number of markings.

The counter 406 can be connected to the liquid container 410 to slide around the circumference of the liquid container 410 to each of the number of indicator points 402-1, 402-2, 402-3, 402-4 . . . 402-N, wherein sliding the counter 406 to each of the consecutive indicator points 402-1, 402-2, 402-3, 402-4 . . . 402-N indicates consumption of a volume of liquid. For example, the counter 406 sliding to each of the consecutive indicator points 402-1, 402-2, 402-3, 402-4 . . . 402-N can indicate a volume and/or amount of liquid consumed within a period of time (e.g., 24 hours, a week, a work shift).

In some embodiments of the present disclosure, the liquid consumption counter device 400 can include a channel 408. For example, the counter 406 and indicator points 402-1, 402-2, 402-3, 402-4 . . . 402-N can be located in the channel 408. In various embodiments, the counter 406 can include a ring that can be located in the channel 408 to rotate around the circumference of the liquid container 410.

To use the liquid consumption counter devices of FIGS. 1-4, at the beginning of a period of time (e.g., day, shift, hour, prior to exercise), a user can move the counter so that the counter points to a beginning marking (e.g., marking zero) on the liquid consumption counter device. Each time the user fills and/or finishes consuming liquid in the liquid container, the user can rotate the counter around the circumference of the liquid consumption counter device. The counter can lock and/or grip at the next indicator point on the liquid consumption device that corresponds to the following marking (e.g., the next numerical value) to count liquid consumed. For example, after finishing a first liquid container of the day, a user can rotate the counter from the marking zero to the marking one. At the end of the period of time, the user can determine the total volume of liquid consumed by observing the number of liquid containers marked on the liquid consumption counter device. For example, the user can multiply the number of liquid containers consumed by the volume and/or amount of liquid the liquid container holds (e.g., 8 ounce cup multiplied by 5 refills).

In some embodiments, a user may be reminded to fill a liquid container with liquid, drink liquid in a liquid container, finish consuming liquid in a liquid container, and/or move the counter to a marking. A user, for example, may be reminded in response to an observation made by a monitoring system. A monitoring system can include a sensory system, observations made by a healthcare professional, and/or user input based on a user's response to questions presented to the user. For instance, a user can be reminded in person, by a telephone, and/or via a computing or other device. A person can include a healthcare professional (e.g., a doctor, nurse, nursing home employee) and/or a person associated with the user. A user can be reminded in response to questions presented to the user, for instance. The questions can be presented periodically, such as daily, for example. The questions can be presented to the user and answered by the user via a telephone and/or a computing or other suitable device, for instance.

For example, the questions can be used to make observations regarding the lifestyle, medical condition of the user, and/or based upon feedback a healthcare professional would want due to changes in the user's lifestyle and/or treatment plan. A user, for instance, may use the questions to initiate a reminder telephone call for consuming liquid and/or the questions can be used to collect information regarding the amount of liquid consumed by the user. The results of the questions can be communicated to others using the Internet (e.g., a domain) and/or a mobile telephone application, for example.

Although specific embodiments have been illustrated and described herein, those of ordinary skill in the art will appreciate that an arrangement calculated to achieve the same techniques can be substituted for the specific embodiments shown. As one of ordinary skill in the art will appreciate upon reading this disclosure, various embodiments of the invention can be performed in one or more devices, device types, and system environments including networked environments.

Combination of the above embodiments, and other embodiments not specifically described herein will be apparent to those of skill in the art upon reviewing the above description. The scope of the various embodiments of the disclosure includes other applications in which the above structures and methods can be used. Therefore, the scope of various embodiments of the disclosure should be determined with reference to the appended claims, along with the full range of equivalents to which such claims are entitled.

In the foregoing Detailed Description, various features may have been grouped together in a single embodiment for the purpose of streamlining the disclosure. This method of disclosure is not to be interpreted as reflecting an intention that the embodiments of the invention require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A liquid consumption counter device comprising:

a body having a number of indicator points, wherein the body includes:

a polymeric hollow truncated cone (HTC) ring; and an elastomeric HTC ring to hold the polymeric HTC ring in place; and a counter coupled to the body, wherein the counter rotates around the body to each of the number of indicator points and wherein rotation of the counter to each of the consecutive indicator points indicates consumption of a volume of liquid.

2. The liquid consumption counter device of claim 1, wherein the body is further configured for placement around a liquid container.

3. The liquid consumption counter device of claim 1, wherein the body further includes a channel.

4. The liquid consumption counter device of claim 3, wherein the number of indicator points and the counter are within the channel on the body.

5. The liquid consumption counter device of claim 1, wherein the number of indicator points are located on the top of the body.

6. The liquid consumption counter device of claim 1, wherein the number of indicator points are located on the middle of the body.

7. The liquid consumption counter device of claim 1, wherein the device further includes a liquid container, wherein the liquid container includes a number of numerical values around the circumference of the liquid container.

8. The liquid consumption counter device of claim 1, wherein the body further includes a number of numerical values around the circumference of the body.

9. The liquid consumption counter device of claim 1, wherein the counter further includes a locking mechanism to lock at the number of indicator points, wherein the counter is resistant to move with basic use of the liquid consumption counter device.

10. The liquid consumption counter device of claim 1, wherein the body includes at least one of a cylinder shape, an elliptical cylinder shape, and a hollow truncated cone shape.

11. A liquid consumption counter device comprising:

an adjustable hollow truncated cone (HTC) including;

a first c-shaped portion including a plurality of female connectors; and a second c-shaped portion including a plurality of male connectors, wherein at least one of the plurality of male connectors couples to at least one of the plurality of female connectors to mechanically adjust a fit of the HTC around a liquid container;

a number of indicator points on the adjustable HTC; and a counter coupled to the adjustable HTC, wherein the counter slides around the circumference of the adjustable HTC to each of the number of indicator points and wherein sliding the counter to each of the consecutive indicator points indicates consumption of a volume of liquid.

12. The liquid consumption counter device of claim 11, wherein the liquid consumption counter further includes markings associated with each of the number of indicator points indicating a volume of liquid.

13. A liquid consumption counter device comprising:

a liquid container including:

a polymeric hollow truncated cone (HTC) ring; and an elastomeric HTC ring to hold the polymeric HTC ring in place;

a number of indicator points on the liquid container, each indicator point indicating an amount of liquid; and a counter connected to the liquid container and configured to slide around the circumference of the liquid container to each of the number of indicator points and wherein sliding the counter to each of the consecutive indicator points indicates consumption of a volume of liquid.

14. The liquid consumption counter device of claim 13, wherein the liquid container includes at least one of a water bottle, a cup, and a disposable cup.

15. The liquid consumption counter device of claim 13, wherein the indicator points are located around the circumference of the liquid container.

16. The liquid consumption counter device of claim 13, wherein the indicator points further include a number of numerical values, wherein the numerical values of the indicator points increase around the circumference of the liquid container until the beginning numerical value is reached.

17. The liquid consumption counter device of claim 13, wherein sliding the counter to each of the consecutive indicator points further indicates a volume of liquid consumption within a period of time.

* * * * *